US006990695B2

(12) United States Patent
Grayson

(10) Patent No.: US 6,990,695 B2
(45) Date of Patent: Jan. 31, 2006

(54) SHOWER PAN

(76) Inventor: A. Brent Grayson, 783 Julia St., Fort Mill, SC (US) 29708

( * ) Notice: Subject to any disclaimer, the term of this patent is extended or adjusted under 35 U.S.C. 154(b) by 110 days.

(21) Appl. No.: 10/227,750

(22) Filed: Aug. 26, 2002

(65) Prior Publication Data

US 2004/0034922 A1 Feb. 26, 2004

(51) Int. Cl.

| | |
|---|---|
| ***A47K 3/22*** | (2006.01) |
| ***A47K 3/34*** | (2006.01) |
| ***A47K 3/36*** | (2006.01) |

(52) U.S. Cl. ..... 4/613; 4/612

(58) Field of Classification Search ..... 4/612–614, 4/584; 52/34, 35

See application file for complete search history.

(56) References Cited

U.S. PATENT DOCUMENTS

| | | | | | |
|---|---|---|---|---|---|
| 2,343,201 | A | * | 2/1944 | Nilson | 4/612 |
| 3,462,771 | A | * | 8/1969 | Moretti | 4/613 |
| 3,501,879 | A | | 3/1970 | Mitchell et al. | |
| 3,606,617 | A | | 9/1971 | Frazier | |
| 3,800,335 | A | * | 4/1974 | Buonaura | 4/613 |
| 3,895,398 | A | * | 7/1975 | Mustee | 4/613 |
| 4,215,444 | A | * | 8/1980 | Brown | 4/612 |
| 4,541,132 | A | | 9/1985 | Long | |
| 4,557,004 | A | | 12/1985 | Piana | |
| 4,993,201 | A | | 2/1991 | Bunyard | |
| D367,522 | S | | 2/1996 | Debs | |
| 6,003,169 | A | * | 12/1999 | Davis, Jr. | 4/613 |
| 6,381,773 | B1 | * | 5/2002 | McAllister | 4/613 |

OTHER PUBLICATIONS

International Cast Polymer Association, How to Install a Cast Polymer Shower Base, Copyright 1997, two pages, ICPA, US.

Virginia Marble Manufacturers, Inc., Virginia Marble Tubs and Shower Pans in Elegant Culture Marble and Onyx, Brochure, 4 pgs, Virginia Marble Manufacturers, Inc., US.

* cited by examiner

*Primary Examiner*—Tuan Nguyen
(74) *Attorney, Agent, or Firm*—Adam Evans P.A.

(57) ABSTRACT

A shower pan for mounting in a shower stall includes a single integrally molded base with a drain hole. A sidewall extends upwardly from the base and completely surrounds the base. A lateral ledge extends outwardly from the sidewall and has an inner edge and an outer edge defining a surface therebetween for mounting a shower stall door track. An outer ridge extends upwardly from the outer edge of the lateral ledge and is in spaced apart relation to the door track. Water flowing through cracks between the door track and the shower pan is prevented from escaping the shower pan by the outer ridge, which allows water to drain under the door track into the shower pan.

17 Claims, 5 Drawing Sheets

SHOWER PAN

TECHNICAL FIELD AND BACKGROUND OF THE INVENTION

The invention relates to a shower pan for use in a shower stall. Such shower pans act as a base in the shower stall on which the user stands while showering, and includes a drain hole for allowing water to drain out of the shower stall.

While shower stalls may be any shape, many are rectangular, having three shower surface walls and a fourth side on which a shower stall door is mounted. An important concern is the prevention of water leakage from the shower stall into surrounding structures outside of the shower stall. In an attempt to prevent leakage, prior art shower pans have utilized a water dam extending upward from the base of the shower pan on all four sides. On the three sides supporting the shower surface walls, a ridge extends upward from the water dam, behind the shower surface walls. The shower door is mounted on the water dam on the remaining side, which does not include a ridge, presumably to allow for the shower door to open and close freely. However, such a configuration allows for water streaming through cracks in the door track on which the door is mounted to escape the shower pan and shower stall as there is no ridge or similar structure to stop the water. It is common for water on the shower door to flow down into the door track. Also, water flowing in between shower surface walls and the drywall behind it flows downward to the water dam, traveling to the front side of the water dam where it contacts the door track. Water seeping through crevices in the door track flows out of the shower stall and can damage surrounding wood structures. Adding sealant is time consuming and not completely effective in stopping leakage.

Therefore, there is a need for a shower pan that effectively stops water leakage from a shower stall, particularly the side of the stall in which the door is positioned. In an effort to overcome and eliminate the aforementioned problems, the present invention was conceived.

SUMMARY OF THE INVENTION

Therefore it is an object of the present invention to provide a shower pan for use in a shower stall that effectively prevents water leakage into structures outside of the shower stall.

It is another object of the present invention to provide a shower pan on which a door track can be mounted, and prevents water streaming past the door track from escaping the shower pan, without inhibiting movement of the shower stall door which is mounted on the door track.

It is yet another object of the present invention to provide a shower pan that prevents water leakage, and does not require sealant.

It is yet another object of the present invention to provide an integrally molded shower pan that can be used in a variety of shower stalls.

These and other objectives of the present invention are achieved by providing a shower pan for mounting in a shower stall in which the shower pan includes an integrally molded piece having a base defining a drain hole therein. A sidewall extends upwardly from the base and completely surrounds the base. A lateral ledge extends outwardly from the sidewall and has an inner edge and an outer edge defining a surface therebetween for mounting a shower stall door track thereon. An outer ridge extends upwardly from the outer edge of the lateral ledge and is in spaced apart relation to the door track. The door track and an inner wall of the outer ridge define a drain area to receive and retain water which would otherwise leak from the shower stall.

According to a preferred embodiment of the invention, the door track is higher than the outer ridge for allowing sufficient clearance of a shower stall door mounted on said door track to open and close over said outer ridge.

According to another preferred embodiment of the invention, the shower pan includes an inner ridge extending upwardly from the inner edge of the lateral ledge and has a height less than the outer ridge. The inner ridge and the outer ridge define a mounting space therebetween for mounting the door track thereon.

According to yet another preferred embodiment of the invention, the inner ridge is adjacent to the door track.

According to yet another preferred embodiment of the invention, the shower pan is made of acrylic fiberglass.

According to yet another preferred embodiment of the invention, the shower pan is made of marble.

According to yet another preferred embodiment of the invention, the sidewall is inclined toward the base to direct water to the drain hole.

According to yet another preferred embodiment of the invention, the base is inclined toward the drain hole to direct water to the drain hole.

According to yet another preferred embodiment of the invention, the lateral ledge supports an upwardly extending shower stall surface wall.

According to yet another preferred embodiment of the invention, the shower stall surface wall is proximate to the outer ridge.

According to yet another preferred embodiment of the invention, the shower pan is rectangular. The sidewall has first, second, third and fourth sides, and the door track is positioned on a portion of the lateral ledge extending from the first side of the sidewall.

According to yet another preferred embodiment of the invention, a shower stall surface wall is positioned on a portion of the lateral ledge extending from the second, third and fourth sides of the sidewall.

According to yet another preferred embodiment of the invention, a waterproof wall board is positioned behind the shower stall surface and above the outer ridge.

An embodiment of the method of making an integrally molded shower pan according to the invention includes the steps of providing a base and forming a drain hole in the base. In addition, a sidewall is formed extending upwardly from the base and completely surrounding the base. A lateral ledge is formed extending outwardly from the sidewall and having an inner edge and an outer edge defining a surface therebetween for mounting a shower stall door track thereon. An outer ridge is formed extending upwardly from the outer edge of the lateral ledge. The door track and an inner wall of the outer ridge define a drain area to receive and retain water which would otherwise leak from the shower stall.

Another embodiment of the method of making an integrally molded shower pan according to the invention includes the step of forming an incline in the base toward the drain hole to direct water thereto.

Another embodiment of the method of making an integrally molded shower pan according to the invention includes the step of forming an incline in the sidewall in relation to the base to direct water to the drain hole.

An embodiment of the method of installing a shower stall door according to the invention includes the steps of providing an integrally molded shower pan having a base defining a drain hole therein, the base being inclined toward the drain hole to direct water thereto, a sidewall extending upwardly from the base and completely surrounding the base, a lateral ledge extending outwardly from the sidewall and having an inner edge and an outer edge defining a surface therebetween for mounting a shower stall door track thereon, and an outer ridge extending upwardly from the outer edge of said lateral ledge. The door track is mounted on the lateral ledge in spaced apart relation to the outer ridge, and a shower stall door is mounted on the door track. The door tack and the outer ridge define a drain area to receive and retain water which would otherwise leak from the shower stall.

Another embodiment of the method of installing a shower stall door according to the invention includes the step of providing an integrally molded rectangular shower pan including a sidewall having first, second, third and fourth sides.

Another embodiment of the method of installing a shower stall door according to the invention includes the step of mounting the door track on a portion of the lateral ledge extending from the first side of the sidewall.

Another embodiment of the method of installing a shower stall door according to the invention includes the step of mounting a shower stall surface wall on a portion of the lateral ledge extending from the second, third and fourth sides of the sidewall.

BRIEF DESCRIPTION OF THE DRAWINGS

Some of the objects of the invention have been set forth above. Other objects and advantages of the invention will appear as the invention proceeds when taken in conjunction with the following drawings, in which.

DESCRIPTION OF THE PREFERRED EMBODIMENT AND BEST MODE

Figure 1:
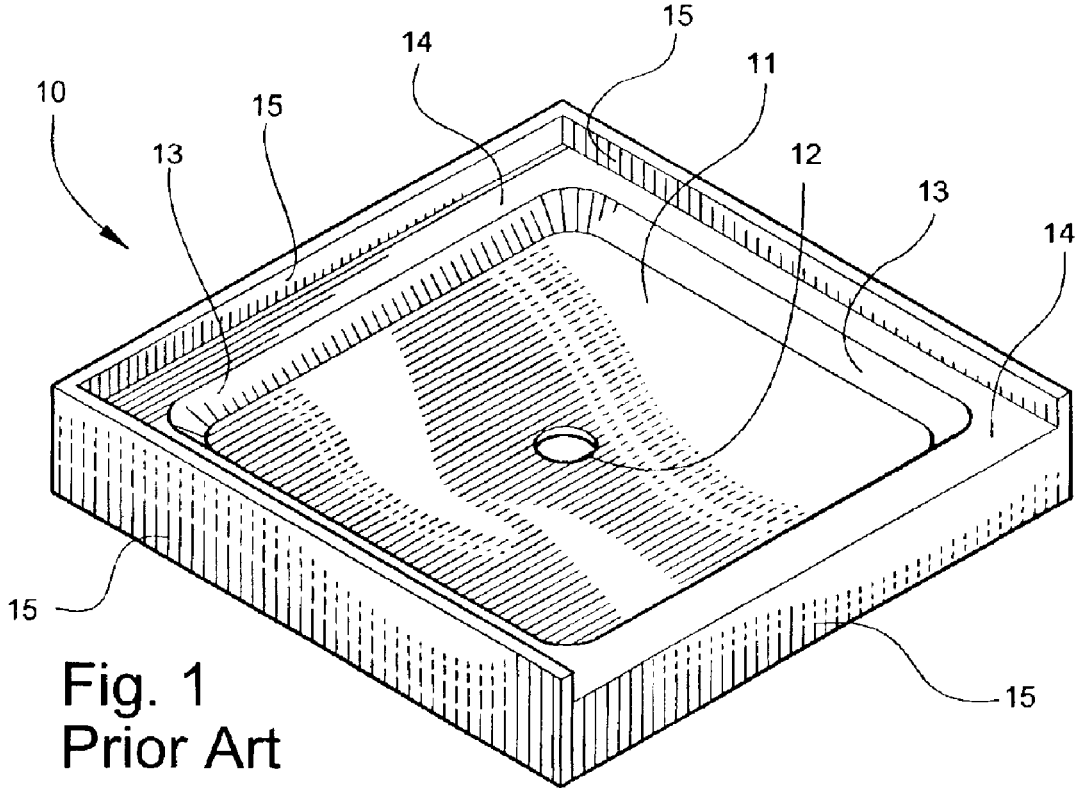
Fig. 1 Prior Art
FIG. 1 is a perspective view of a shower pan according to the prior art.

Referring now specifically to the drawings, a shower pan 10 according to the prior art is illustrated in FIG. 1, and shown generally at reference numeral 10. The prior art shower pan comprises a rectangular base 11 with a drain hole 12 located in the center of the base 11 for draining water out of a shower stall. A sidewall 13 extends upwardly from the base 11, and a lateral ledge 14 extends outwardly from the top of the sidewall 13. On three sides of the shower pan 10, an outer wall 15 extends above the outer edge of the lateral ledge 14. On one side of the shower pan, the outer wall 15 terminates at the outer edge of the lateral ledge 14.

Figure 2:
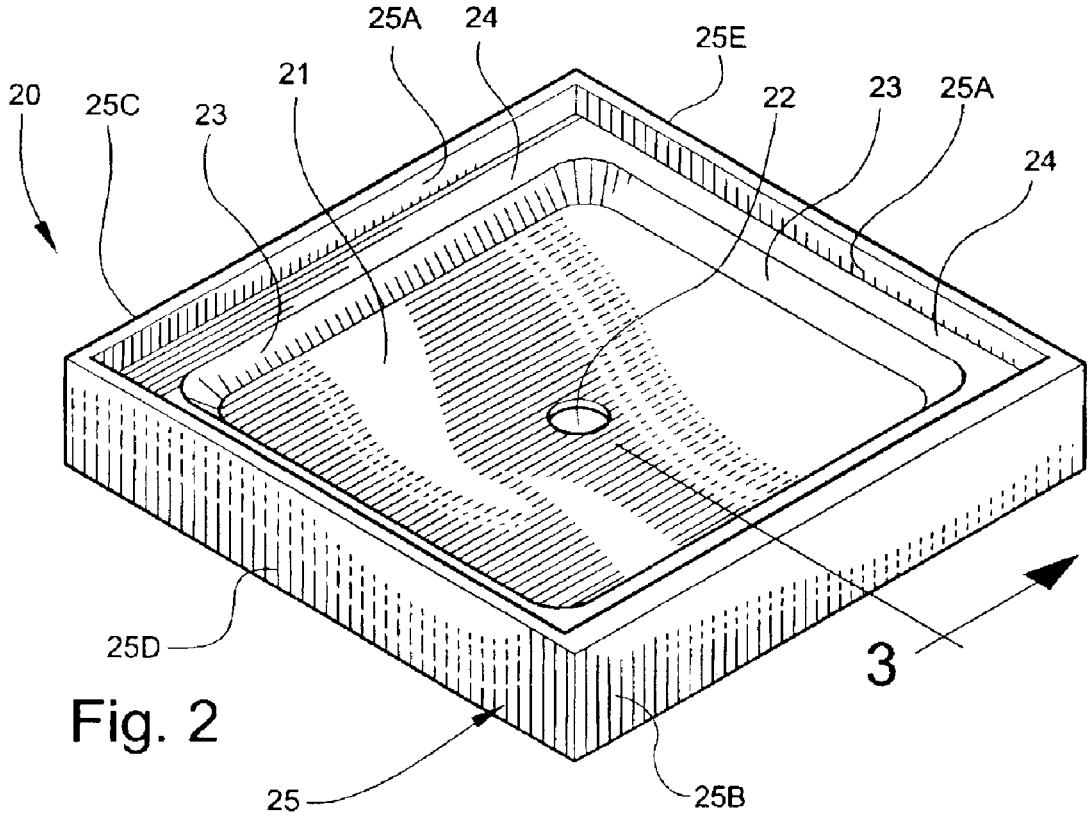
FIG. 2 is a perspective view of a shower pan according to a preferred embodiment of the invention.
Figure 3:
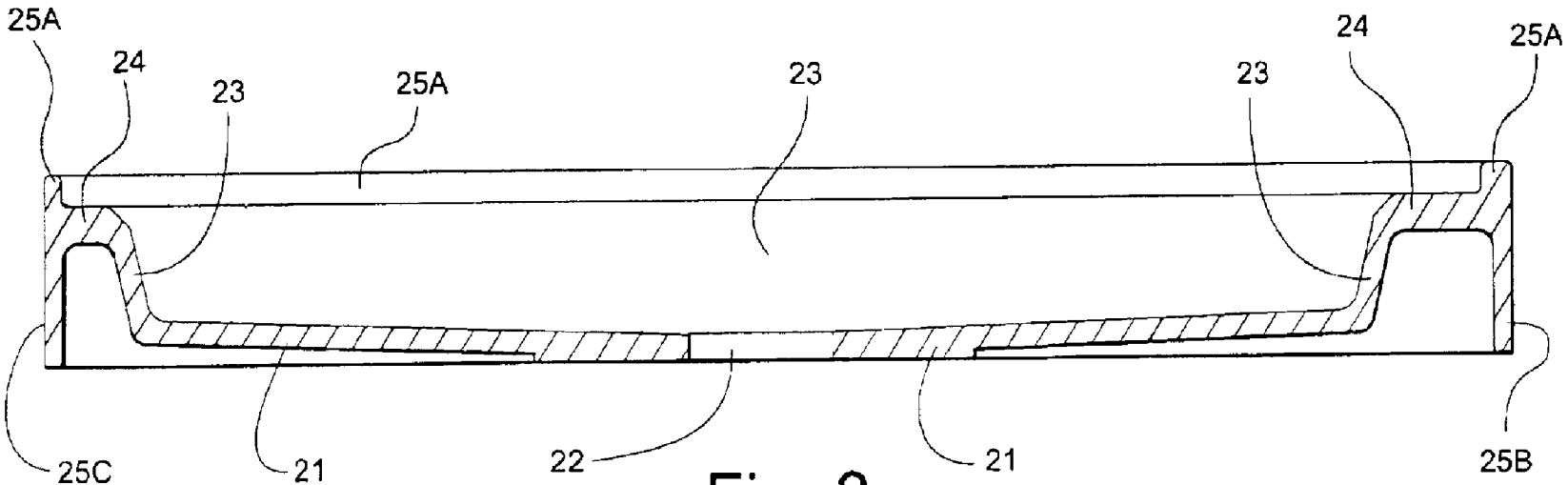
FIG. 3 is a cross sectional view of the shower pan of FIG. 2 shown along line 3.

A shower pan according to a preferred embodiment of the present invention is illustrated in FIG. 2, and shown generally at reference numeral 20. The shower pan 20 comprises a rectangular base 21 having a drain hole 22 located in the center of the base 21. A sidewall 23 extends upwardly from the base 21, and a lateral ledge 24 extends outwardly from the sidewall 23. An outer wall 25 extends above the outer edge of the lateral ledge 24 on all four sides of the shower pan 20. As shown in FIGS. 2 and 3, the portion of the wall 25 extending above the lateral ledge 24 forms an outer ridge 25A that surrounds the entire perimeter of the lateral ledge 24 and prevents the escape of water. The outer wall 25 comprises four sides: front side 25B, rear side 25C, left side 25D, and right side 25E.

The entire shower pan 20 is a single integrally molded piece, preferably made of acrylic fiberglass, marble, plastic or some other suitable water resistant material. While the shower pan 20 is shown as being preferably rectangular, it can be any variety of shapes such as pentagonal, hexagonal, elliptical or circular.

As shown in FIGS. 2 and 3, the sidewall 23 is preferably inclined at an angle slightly greater than ninety degrees with respect to the base 21 in order to facilitate movement of the water into the base 21. Similarly, the base 21 is sloped toward the drain hole 22 to move water into the drain hole 22 and out of the shower pan 20.

Figure 4:
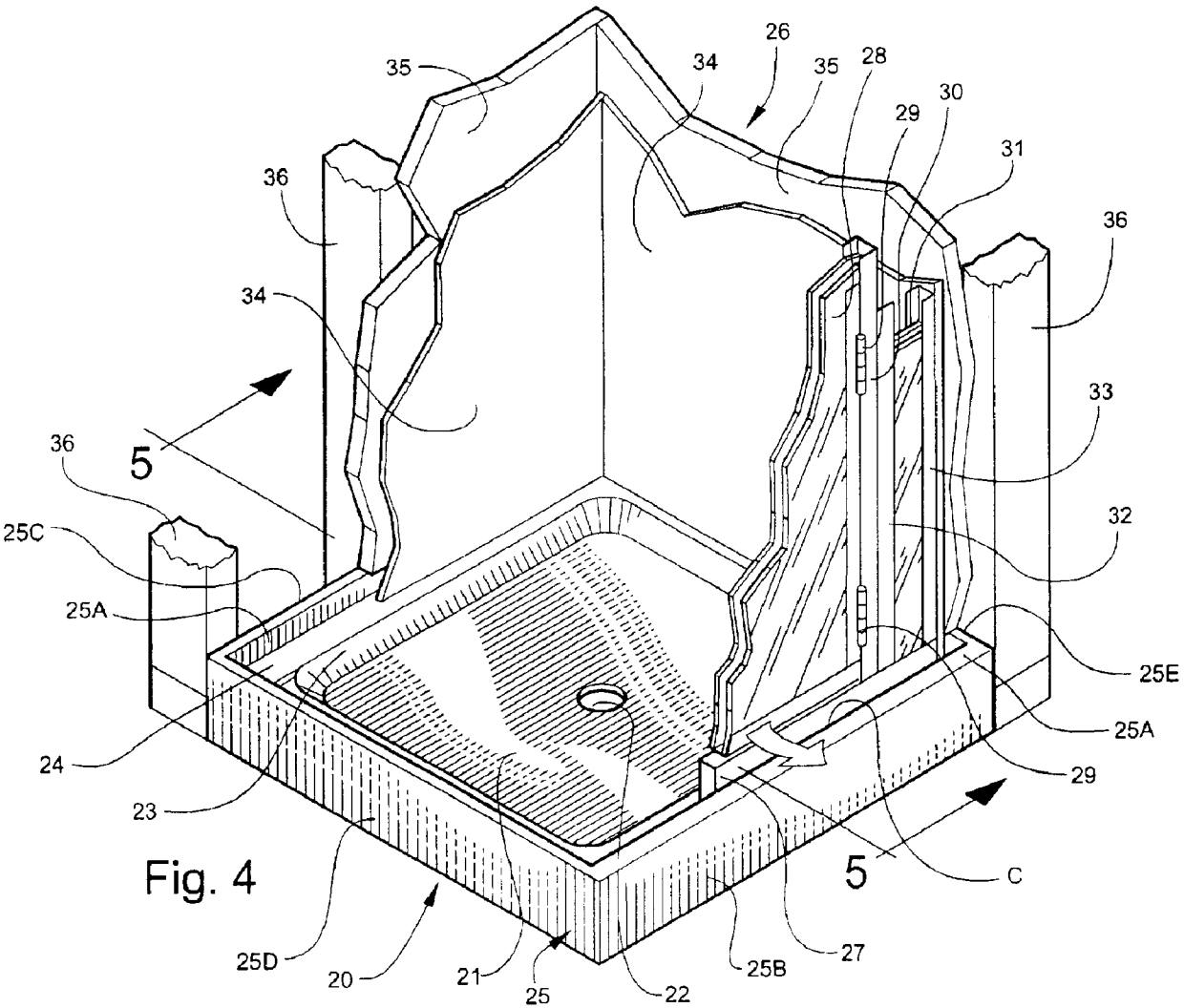
FIG. 4 is a partial perspective view of the shower pan of FIG. 2 installed in a shower stall.

As shown in FIG. 4, the shower pan 20 is installed for use in conjunction with a shower stall unit 26. A shower door track 27 is positioned on top of the lateral ledge 24 on the front side 25B of the outer wall 25 proximate the outer ridge 25A. The door track receives a vertical U-shaped member 33 at one end of the door track 27. A shower stall surface wall 34 is mounted on the lateral ledge 24 on rear side 25C, left side 25D and right side 25E. The shower stall surface wall 34 is positioned in front of the outer ridge 25A. A waterproof wall board 35 is positioned behind the shower stall surface 34, and construction studs 36 are mounted on a floor "F" behind the wall board 35. The wall board 35 is positioned above outer ridge 25A. The U-shaped member 33 is attached to the shower surface wall 34 positioned on the right side 25E. The door track 27 receives a like U-shaped member at the opposite end of the door track 27 (not shown), which is attached to the shower surface wall 34 positioned on the left side 25D. As such, the door track 27 remains in place on the shower pan 20, without any adhesive, nor is any sealant needed to prevent leakage due to outer ridge 25A, as described below. Alternatively, the door track 27 can be affixed to the lateral ledge 24 by any water resistant adhesive.

Figure 5:
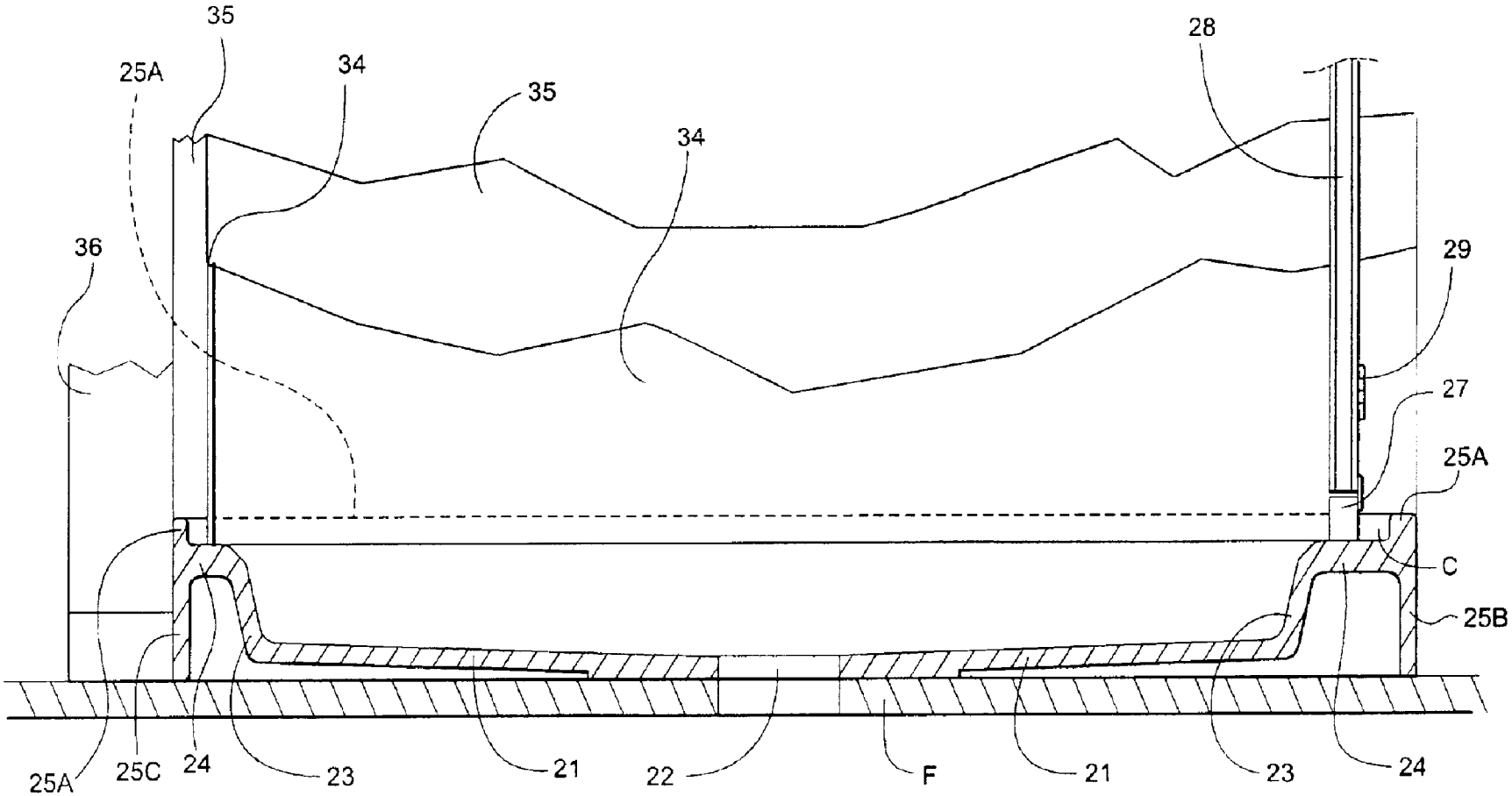
FIG. 5 is a cross sectional view of the shower pan and shower stall of FIG. 4 shown along lines 5—5.

The door track 27 should be higher than the outer ridge 25A so that the door track 27 can receive a shower door 28 without being obstructed by the outer ridge 25A. Preferably, the door track 27 is not adjacent to the outer ridge 25A, but rather spaced apart so that a small channel "C" exists between the door track 27 and the outer ridge 25A, as shown in FIG. 5. As such, water streaming down the door track 27 is caught within the channel C and ultimately flows down into the base 21 or evaporates. No sealant is necessary between the door track 27 and the shower pan 20, since water that escapes through the door track 27 will flow into channel C and be prevented from exiting the shower pan by the outer ridge 25A, flowing instead under the door track 27 over lateral ledge 24 and into the base 21. In addition, outer ridge 25A prevents water flowing between the shower stall surface wall 34 and the wall board 35 from escaping out of the shower pan 20. By surrounding all sides of the lateral ledge 24 with outer ridge 25A, leakage between the shower stall surface wall 34 and the wall board 35 is contained within the shower pan 10

As shown in FIG. 4, a shower door 28 is mounted on hinges 29 carried by a U-shaped member 30 extending vertically from the door track 27. The shower door 28 is preferably made of tempered glass or other suitable water resistant material. An additional glass wall 31 is positioned on the front side 25B of the shower pan 20 adjacent to the shower door 28. Glass wall 31 is mounted between two U-shaped members 32, 33. As shown in FIG. 5, the surface area of lateral ledge 24 on the front side 25B of shower pan 20 is substantially greater than on the other sides 25C–E, in order to accommodate the door track 27. In addition, the portion of outer ridge 25A on front side 25B is thicker than the outer ridge portion on sides 25C–E.

Figure 6:
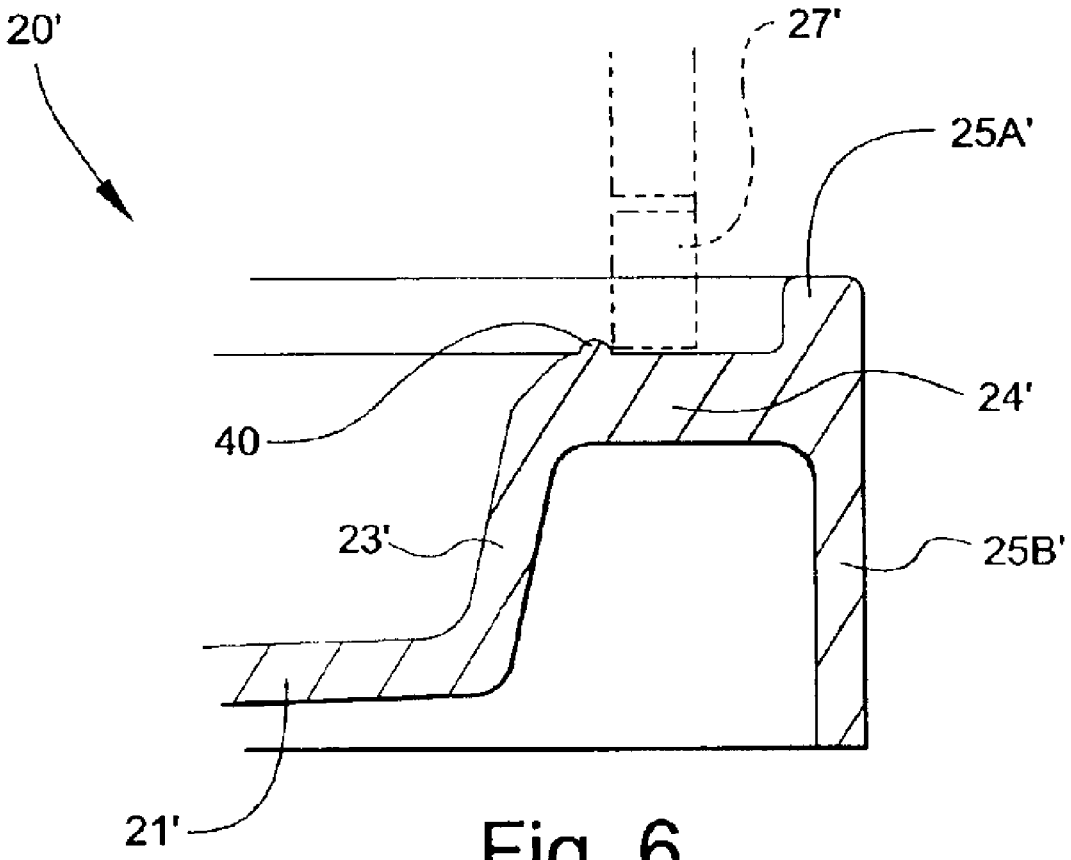
FIG. 6 is a partial cross sectional view of a shower pan according to another embodiment of the invention, with a shower door track shown in phantom.

In an alternative embodiment of the invention shown in FIG. 6, a shower pan 20' includes an inner ridge 40 positioned on the inner edge of lateral ledge 24'. Lateral ledge 24' extends outwardly from sidewall 23', which extends upwardly from base 21'. The inner ridge 40 is substantially smaller than the outer ridge 25A'. A door track 27' (shown in phantom in FIG. 6) is positioned on the lateral ledge 24' adjacent to the inner ridge 40. The inner ridge 40 provides additional stability to the door track 27'.

A shower pan and a method of using same is disclosed above. Various embodiments of the invention can be made without departing from its scope. Furthermore, the foregoing description of the preferred embodiment of the invention and the best mode for practicing the invention are provided for the purpose of illustration only and not for the purpose of limitation—the invention being defined by the claims.

I claim:

1. A single, integrally molded shower pan for mounting in a shower stall comprising:

(a) a base defining a drain hole therein, and at least first, second and third sides;

(b) a sidewall extending upwardly from said base and completely surrounding said base;

(c) a lateral ledge extending outwardly from said sidewall and having an inner edge and an outer edge defining a surface therebetween for mounting a shower stall door track thereon, the door track coextensive with the first side of the base; and (d) an outer ridge extending upwardly from the outer edge of said lateral ledge and in spaced apart relation to said door track, whereby the outer ridge and the door track define a drain area therebetween to receive and retain water which would otherwise leak from the shower stall.

2. The single, integrally molded shower pan according to claim 1, wherein said door track is higher than said outer ridge for allowing sufficient clearance of a shower stall door mounted on said door track to open and close over said outer ridge.

3. The single, integrally molded shower pan according to claim 1, and further comprising an inner ridge extending upwardly from the inner edge of said lateral ledge and having a height less than said outer ridge, said inner ridge and said outer ridge defining a mounting space therebetween for mounting said door track therein.

4. The single, integrally molded shower pan according to claim 3, wherein said inner ridge is adjacent to said door track.

5. The single, integrally molded shower pan according to claim 1, wherein the shower pan is comprised of acrylic fiberglass.

6. The single, integrally molded shower pan according to claim 1, wherein the shower pan is comprised of plastic.

7. The single, integrally molded shower pan according to claim 1, wherein said sidewall is inclined toward said base to direct water to the drain hole.

8. The single, integrally molded shower pan according to claim 1, wherein said base is inclined toward said drain hole to direct water thereto.

9. The single, integrally molded shower pan according to claim 1, wherein said lateral ledge is adapted for supporting an upwardly extending shower stall surface wall.

10. The single, integrally molded shower pan according to claim 1, wherein said lateral ledge is adapted for supporting a shower stall surface wall proximate to said outer ridge.

11. The single, integrally molded shower pan according to claim 1, wherein the shower pan is rectangular, said sidewall having first, second, third and fourth sides, and further wherein a portion of said lateral ledge extending from the first side of said sidewall is adapted for supporting the door track.

12. The single, integrally molded shower pan according to claim 11, wherein a portion of said lateral ledge extending from the second, third and fourth sides of the sidewall is adapted for supporting a shower stall surface wall.

13. A method for making a single, integrally molded shower pan for mounting in a shower stall comprising the steps of:

(a) providing a base defining at least first, second, and third sides;

(b) forming a drain hole in the base;

(a) forming a sidewall extending upwardly from the base and completely surrounding the base;

(d) forming a lateral ledge extending outwardly from the sidewall and having an inner edge and an outer edge defining a surface therebetween;

(e) mounting a shower stall door track on the surface between the inner edge and the outer edge, the door track coextensive with the first side of the base; and (f) forming an outer ridge extending upwardly from the outer edge of said lateral ledge and in spaced apart relation to the door track, whereby the outer ridge and the door track define a drain area therebetween to receive and retain water which would otherwise leak from the shower stall.

14. The method for making a single, integrally molded shower pan according to claim 13, and further comprising the step of forming an incline in the base toward the drain hole to direct water thereto.

15. The method for making a single, integrally molded shower pan according to claim 13, and further comprising the step of forming an incline in the sidewall in relation to the base to direct water to the drain hole.

16. The method for making a single, integrally molded shower pan according to claim 13, the step of mounting the door track includes positioning the door track to be higher than the outer ridge to allow for sufficient clearance of a shower stall door mounted on said door track to open and close over said outer ridge.

17. The method for making a single, integrally molded shower pan according to claim 16 further comprising the step of mounting the shower stall door on the door track.

* * * * *